US009840898B2

(12) United States Patent
Kasevich et al.

(10) Patent No.: US 9,840,898 B2
(45) Date of Patent: Dec. 12, 2017

(54) SYSTEM AND METHODS FOR CONTROLLED FRACTURING IN FORMATIONS

(71) Applicant: Chevron U.S.A. Inc., San Ramon, CA (US)

(72) Inventors: Raymond Stanley Kasevich, Mt. Washington, MA (US); Jeb Xiaobing Rong, Mt. Washington, MA (US); James Preston Koffer, Delta, CO (US); Mark Dean Looney, The Woodlands, TX (US); Margaretha Catharina Maria Rijken, Houston, TX (US)

(73) Assignee: CHEVRON U.S.A. INC., San Ramon, CA (US)

( * ) Notice: Subject to any disclaimer, the term of this patent is extended or adjusted under 35 U.S.C. 154(b) by 177 days.

(21) Appl. No.: 14/568,779

(22) Filed: Dec. 12, 2014

(65) Prior Publication Data

US 2015/0167440 A1 Jun. 18, 2015

Related U.S. Application Data

(60) Provisional application No. 61/915,785, filed on Dec. 13, 2013.

(51) Int. Cl.
*E21B 43/26* (2006.01)
*E21B 43/16* (2006.01)
(Continued)

(52) U.S. Cl.
CPC ..... *E21B 43/26* (2013.01); *E21B 7/15* (2013.01); *E21B 33/124* (2013.01);
(Continued)

(58) Field of Classification Search
CPC .... E21B 33/124; E21B 43/003; E21B 43/168; E21B 43/24; E21B 43/26
See application file for complete search history.

(56) References Cited

U.S. PATENT DOCUMENTS 3,169,577 A 2/1965 Sarapuu
3,236,304 A * 2/1966 Sarapuu ..... E21B 43/11 166/248

(Continued)

FOREIGN PATENT DOCUMENTS

WO 2013/149308 A1 10/2013

OTHER PUBLICATIONS

Written Opinion of the International Searching Authority and International Search Report for PCT/US2014/070037 dated Mar. 31, 2015, 9 pages.

(Continued)

*Primary Examiner* — Jennifer H Gay

(57) ABSTRACT

Controlled fracturing in geologic formations is carried out by a system for generating fractures. The system comprises: a plurality of electrodes for placing in boreholes in a formation with one electrode per borehole, for the plurality of electrodes to define a fracture pattern for the geologic formation; a first electrical system for delivering a sufficient amount of energy to the electrodes to generate a conductive channel between the pair of electrodes with the conductivity in the channel has a ratio of final to initial channel conductivity of 10:1 to 50,000:1, wherein the sufficient amount of energy is selected from electromagnetic conduction, radiant energy and combinations thereof; and a second electrical system for generating electrical impulses with a voltage output ranging from 100-2000 kV, with the pulses having a rise time ranging from 0.05-500 microseconds and a half-value time of 50-5000 microseconds.

21 Claims, 5 Drawing Sheets

(51) Int. Cl.

| | |
|---|---|
| ***E21B 43/24*** | (2006.01) |
| ***E21B 33/12*** | (2006.01) |
| ***E21B 7/15*** | (2006.01) |
| ***E21B 43/00*** | (2006.01) |
| ***E21B 33/124*** | (2006.01) |

(52) U.S. Cl.
CPC ..... *E21B 43/006* (2013.01); *E21B 43/168* (2013.01); *E21B 43/24* (2013.01)

(56) References Cited

U.S. PATENT DOCUMENTS 3,279,540 A 10/1966 Lange
3,292,701 A 12/1966 Goodwin
3,460,766 A 8/1969 Sarapuu
3,474,878 A 10/1969 Loren
3,695,715 A 10/1972 Godfrey
3,794,976 A 2/1974 Mickler
4,046,194 A * 9/1977 Cloud ..... E21B 43/2401 166/248
4,084,638 A * 4/1978 Whiting ..... E21B 43/003 166/248
4,135,579 A * 1/1979 Rowland ..... E21B 43/2401 166/248
4,140,179 A 2/1979 Kasevich et al.
4,196,329 A * 4/1980 Rowland ..... E21B 43/2401 166/248
4,199,025 A * 4/1980 Carpenter ..... E21B 36/00 166/245
4,282,587 A 8/1981 Silverman
4,320,801 A * 3/1982 Rowland ..... E21B 43/2401 166/248
4,348,635 A 9/1982 Wright
4,468,623 A 8/1984 Gianzero
4,479,680 A 10/1984 Wesley
4,557,325 A 12/1985 Gall
4,567,945 A * 2/1986 Segalman ..... E21B 17/003 166/248
4,640,353 A * 2/1987 Schuh ..... E21B 7/061 166/117.6
4,653,697 A * 3/1987 Codina ..... B02C 19/18 241/1
4,667,738 A 5/1987 Codina
4,741,405 A 5/1988 Moeny et al.
5,243,521 A 9/1993 Luthi
5,355,802 A 10/1994 Petitjean
5,573,307 A 11/1996 Wilkinson
5,620,049 A 4/1997 Gipson
6,023,168 A 2/2000 Minerbo
6,148,911 A 11/2000 Gipson
7,270,195 B2 9/2007 MacGregor
7,520,324 B2 4/2009 Chen
7,631,691 B2 12/2009 Symington
7,819,181 B2 10/2010 Entov
8,220,537 B2 7/2012 Leon
8,869,888 B2 10/2014 Cramer
9,243,487 B2 * 1/2016 Geilikman ..... E21B 43/26
9,328,594 B2 5/2016 Linetskiy
9,394,775 B2 * 7/2016 Rey-Bethbeder ..... E21B 36/04
2003/0137182 A1 7/2003 Moeny
2003/0173082 A1 9/2003 Vinegar et al.
2005/0150688 A1 7/2005 MacGregor
2007/0107901 A1 5/2007 Maguire
2007/0152494 A1 7/2007 Moeny
2007/0256830 A1 11/2007 Entov
2008/0230219 A1 9/2008 Kaminsky
2009/0166024 A1 7/2009 Chen
2010/0101793 A1 4/2010 Symington
2010/0229749 A1 9/2010 Veneruso
2011/0060572 A1 3/2011 Brown et al.
2011/0065161 A1 3/2011 Kwasinski et al.
2012/0325458 A1 12/2012 El-Rabaa
2013/0112403 A1 5/2013 Meurer
2013/0255936 A1 * 10/2013 Geilikman ..... E21B 43/26 166/248
2014/0008072 A1 * 1/2014 Rey-Bethbeder ..... E21B 36/04 166/308.1
2014/0008073 A1 * 1/2014 Rey-Bethbeder ..... E21B 36/04 166/308.1
2014/0032116 A1 1/2014 Guner et al.
2014/0239956 A1 8/2014 Hoversten
2014/0374084 A1 12/2014 Mace
2014/0374091 A1 12/2014 Wilt
2015/0040788 A1 2/2015 Albakri
2015/0167439 A1 6/2015 Kasevich et al.
2015/0167440 A1 * 6/2015 Kasevich ..... E21B 33/124 166/52

OTHER PUBLICATIONS

"Enhancing Appalachian Coalbed Methane Extraction by. Microwave-Induced Fractures." Dated Aug. 5, 2010 by Dr. Jonathan P. Mathews, Hemant Kumar, EMS Energy Institute and the Energy & Mineral Engineering Department, The Pennsylvania State University, 133 pages.
Fracturing Oil Shale With Electricity, Laramie Petroleum Research Center, Bureau of Mines, Laramie Wyoming, Quarterly of the Colorado School of Mines, 1963, V. 63 #3, pp. 613-627.
An Overview of In Situ Recovery Research at the Laramie Energy Technology Center, by Harak et al., Energy Technology Conference and Exhibition, Houston, Texas, Nov. 5-8, 1978, 28 pages.
Dynamic fragmentation of rock by high-voltage pulses, Cho et al., American Rock Mechanics Association, 2006, ARMA/USRMS 06-1118, 9 pages.
Microwave-assisted rock breaking modelling and application, B Monchusi, CSIR Centre for Mining Innovation, South Africa, Oct. 2012, 1 page.
International Search Report for PCT.US2014/070037 dated Mar. 31, 2015, 3 pages.
"Electrical Impedance"; (definition); Physics, downloaded on May 5, 2017: https://www.britannica.com/science/electrical-impedance.
Liu, Lanbo; "Fracture Characterization Using Borehole Radar: Numerical Modeling"; Water, Air, and Soil Pollution: Focus (2006), vol. 6, pp. 17-34.
MacDonald, J. Ross; "Impedance Spectroscopy"; (1992), Annals of Biomedical Engineering, vol. 20, pp. 289-305.
Sarapuu, Erich; "Electrofrac Heatflood is a Cyclic, Electrically Augmented In Situ Combustion Process for Oil Well Stimulation and Enhanced Oil Recovery"; Thesis, 2005, no page numbers.

* cited by examiner

SYSTEM AND METHODS FOR CONTROLLED FRACTURING IN FORMATIONS

CROSS-REFERENCE TO RELATED APPLICATIONS

This application claims benefit under 35 USC 119 of U.S. Provisional Patent Application No. 61/915,785 with a filing date of Dec. 13, 2013, which is incorporated herein by reference in its entirety.

TECHNICAL FIELD

The invention relates generally relate to methods for controlled fracturing in formations to improve permeability.

BACKGROUND

It is known in the art to fracture rocks by passing pulses of current between electrodes within a formation. Melton and Cross in Quarterly, Colorado School of Mine, July 1967, Vol. 62, No. 3, pp. 25-60, disclosed field tests in which alternating current electricity was passed through oil shale to create horizontal permeable paths for subsequent fire flooding to heat the oil shale and produce hydrocarbons by thermal cracking of kerogen.

In U.S. Pat. No. 7,631,691, methods are disclosed to fracture a formation by first providing wells in a formation, and then one or more fractures are established in the formation such that each fracture intersects at least one of the wells. Electrically conductive material is subsequently placed in the fracture, and an electric voltage is applied across the fracture and through the material to generate heat to pyrolyze organic matter in the formation to form producible hydrocarbons.

U.S. Pat. No. 7,270,195 discloses methods and apparatuses to form a bore during drilling operations by plasma channel drilling using high voltage, high energy, and rapid rise time electric pulses. US Patent Publication No. 2013/0255936 discloses a method to produce hydrocarbons from a formation by applying differential voltage between a pair of electrodes placed within a formation to remove a fraction between $10^{-6}$ and $10^{-4}$ of the mineral mass in the formation between the electrodes, followed by the production of hydrocarbons, e.g., natural gas, from the formation.

There is still a need for improved systems and methods for fracturing of formations, particularly controlled fracturing in large volumes of tight geologic formations to create multi-dimensional patterns of fracture within, for the economic recovery of any of solids, liquids and gases.

SUMMARY

In one aspect, the invention relates to a method of creating dynamic fracture patterns in tight geologic formations, the method comprising: applying high voltage preconditioning of specific volumes of geologic structure such as oil shale or natural gas shale by volumetric ionization using conductive electromagnetic energy; followed by high current, high energy discharges to generate plasma and associated shock waves for localized rock mineral and multiple fracturing.

In a second aspect, the invention relates to a method of dynamic rock fracture in a rock matrix, comprising: using a multiple of locations of high voltage borehole electrodes with at least one electrode per well to define the fracture pattern required within a specific geologic volume of the rock matrix; applying energy to the volume to be fractured causing electrical breakdown channels and fractures in the rock matrix sufficient to establish low resistance in a channel between electrodes; applying high voltage, high current to the channel in between the electrodes; measuring the resultant change in volume electrical resistance between electrodes of the formation by impedance measurement methods applied both at the surface and downhole; and periodically applying high voltage waveforms of required intensity, time duration and shape between electrodes to create multiple pathways of fracture through rock disintegration of minerals and some pyrolysis of organic material, thereby releasing any trapped oil and gas.

In one embodiment, the electrode structure comprises secondary electrodes to provide enhancements of electric fields at the electrode surfaces suitable for borehole application; and wherein the electromagnetic field patterns created either by structure of transmission lines or electrodes can be altered in time phasing of input current or voltage to change the energy distribution between boreholes and thereby achieve more uniform fracturing in the volume intended.

In one embodiment, an easily ionizable gas may be injected from the electrode surface into the formation for lowering the electrode surface electric field intensity requirements for initiating electrical discharges.

In one aspect, the invention relates to a system for generating fractures in geologic formation. The system comprises: a plurality of electrodes for placing in boreholes in a formation with one electrode per borehole, for the plurality of electrodes to define a fracture pattern for the geologic formation; a first electrical system for delivering a sufficient amount of energy to the electrodes to generate at least a conductive channel between a pair of electrodes with the conductivity in the channel having a ratio of final to initial channel conductivity of 10:1 to 50,000:1, the sufficient amount of energy applied to the electrodes to generate the conductive channel is selected from electromagnetic conduction, radiant energy and combinations thereof; a second electrical system for generating electrical impulses with a voltage output ranging from 100-2000 kV, with the pulses having a rise time ranging from 0.05-500 microseconds and a half-value time of 50-5000 microseconds; wherein the application of the electrical pulses generate multiple fractures surrounding and within the conductive channel by disintegration of minerals and inorganic materials and pyrolysis of organic materials in the formation.

DETAILED DESCRIPTION

Figure 1:
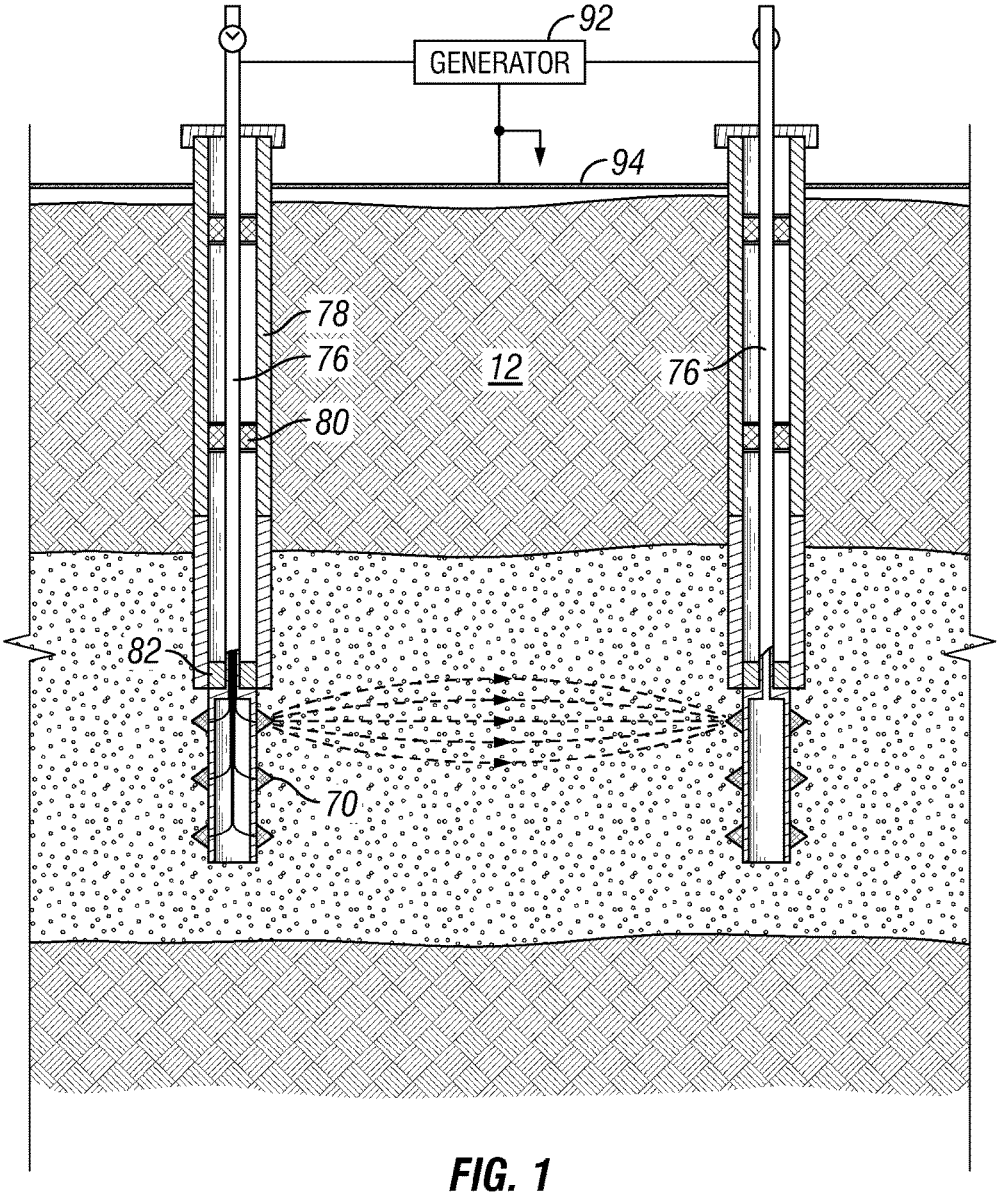
FIG. 1 illustrates an embodiment of a system of the invention.

The invention relates to a system and a method employing a combination of alternating and impulse current waveforms applied in succession to achieve extensive fracturing and disintegration of rock materials, generating three dimensional fracture patterns. In a pre-conditioning step, alternating current (e.g., AC or half-wave AC) electric field is applied to electrodes in the formation. The electrical discharge reduces the formation resistivity by dielectric heating and ionization, causing the rock to fracture with disintegration in multiple directions (micro-fracturing), but confined between the locations of electrode pairs of opposite polarity, effecting carbon production to establish conductive channels in the formation.

As used herein, "channel" refers to a direct path in the formation in between two electrodes, following the established electric field pattern after the application of high voltage to the electrodes. The channel is characterized as having different physical and chemical characteristics from the surrounding rock formation, e.g., having increased content of iron oxides, various ions, carbon, and higher electrical conductivity compared to original properties. The channel may or not be continuous, e.g., with some variations in properties along the length. The size of the channel (e.g., width, diameter, etc.) varies depending on the formation characteristics, electrode spacings, and the applied voltage, current flow and frequency.

After pre-conditioning and once low resistivity condition is achieved, impulse current waveforms are applied to the established channels to create ionization leading to intense plasma discharge along the created conductive path, resulting in rapid heating and pressurization of the surrounding rock, connate water, and any contained energy along the conductive path, resulting in rock disintegration with attendant large scale multiple fracturing.

A system of plurality of borehole electrodes can be employed in this method, for any of enhanced hydrocarbon recovery, mineral recovery, environmental remediation applications, and remediating formation damages. "Formation damage" and its related terms (e.g., damaged formation) generally refer to a reduction in the capability of a reservoir to produce minerals, fluids (e.g., oil and gas), such as a decrease in porosity or permeability or both. Formation damages can be caused by physical plugging of pores, alteration of reservoir rock wettability, precipitation of insoluble materials in pore spaces, clay swelling, and blocking by water (i.e., water blocks).

The method does not require additional water to generate fractures. Therefore, it alleviates the need associated with hydraulic fracturing for sourcing water in arid regions, water disposal, and changes to the formation caused by penetration of fluids into the reservoir. In addition, hydraulic fracture direction is dependent on stress direction in the reservoir. Since the method generates fractures between two points regardless of stress direction, unwanted growth of fractures out of zone is mitigated, avoiding potential loss of production to thief zones and affecting the groundwater. By controlling the direction of fracture growth, optimum production patterns, both vertically and horizontally, can be generated to more efficiently drain reservoirs, increasing both rate and ultimate production totals.

The increase in permeability of the subterranean formation correlates to a gain (or increase) in permeability of at least 50% in one embodiment; at least 80% in a second embodiment. Rock permeability is greatly enhanced after fracturing by ratios ranging from 2:1 to 1000:1 in one embodiment; and from 10:1 to 500:1 in a second embodiment.

High Voltage Pre-Conditioning with Alternating Current:

In one embodiment, conductive electromagnetic energy over a wide range of frequencies from 50 Hz to 100 MHz is applied by a system of electrodes to precondition a specific volume of the formation by altering its electrical, chemical and physical properties. The frequencies range from 100 Hz to 50 MHz in a second embodiment; and from 500 to 10 MHz in a third embodiment. The applied voltage, current flow and frequency can be adjusted in accordance with the measured resistance between the electrodes, which ranges between 10 to 1,000,000 ohms in one embodiment; from 1000 to 500,000 ohms in a second embodiment, depending on variables including but not limited to the physical and chemical parameters of the formation and the distance between the electrodes.

High Current Fracturing:

After the pre-conditioning step, a current impulse generator replaces the AC power source to apply high voltage and high current pulse waveforms that are site-specific to the channels created in the pre-conditioning step. In one embodiment, two separate generators are employed. The first generator is for preconditioning, and the second generator is for extensive fracturing of the formation by pulsation of intense current waveforms. In another embodiment, a single generator may be used as both a preconditioning source and impulse voltage source, since the impulse voltage generator contains an AC transformer to deliver electrical charge to the capacitor bank.

The actual current and voltage waveform selected for the fracturing process may vary with the type of rock crystalline structure, organic content and its frequency sensitive impedance characteristics. The application of the voltage waveform produces an intense channel current waveform because of the "short-circuit condition" established during pre-conditioning. In one embodiment, the rise time is at a level of microseconds or less, e.g., in a range of 1-50 μs. In another embodiment, the rise time is in a range of 50-500 μs.

With the application of high voltage bursts of energy, e.g., high voltage, high current e.g., in a range of 10-10,000 kJ (kilo-joule) in one embodiment, from 50-1000 kJ in a second embodiment, an electrical plasma arc burst along the highly conductive path is instantly created. The plasma arc burst raises temperature and the pressure to extreme ranges, e.g., tens of thousands of degrees Fahrenheit and thousands of pounds per square inch. This rapid increase of temperature and pressure exceeds the strengths of the rock, and causes physical changes and damage in the rock formation along and about or surrounding the highly conductive path, which produces fractures that are desirable for well and formation stimulation, e.g., release of hydrocarbons. The step, i.e., application of high voltage pulsed energy, can be repeated to increase the fracturing effect on the rock and further enhance stimulation of extensive but controlled volumetric fracturing. The fractures are within the conductive channel in one embodiment, and in the volume area surrounding the conductive path from a few inches to 5 feet away in a second embodiment; up to 20 feet away from the conductive path in a third embodiment; up to 50 ft. away in a fourth embodiment.

Electrode System:

In one embodiment, a plurality of insulated positive and negative electrodes are placed into wellbores in the formation at either end of desired path(s) via wells, holes, or natural openings, with the electrodes contacting the earth at desired points where permeable path(s) or channels are to be developed between pairs of positive and negative electrodes. Each electrode is electrically connected to a high voltage cable or cylinder located within the borehole. Distance between each pair of electrodes ranges between 5-2500 ft. in one embodiment, from 10-1000 ft. in a second embodiment; from 25-500 in a third embodiment. Various electric field patterns can be created by multiples of electrode configurations, with the distance between the electrodes, size, frequency, and polarity varying to create the desired pattern, e.g., arrays of electrodes for overlapping and crisscrossing patterns. Examples of electrode configurations include but not limited to two-wire transmission line, four-wire transmission line, cage-like transmission line structure, antennas, etc, and combinations thereof. The voltage polarities of each electrode are also selected to give the highest number of possible channels within a given volume of the formation. The voltages applied can be time-phased to specific electrode spacings and depths.

In one embodiment, the electrode electric field is radially directed away from its surface and enhanced at specific points along the electrode length corresponding in position to the voltage node positions. The enhancements can be in the form of metal point(s), or secondary electrode(s) extending from pipe electrode into the formation. The secondary electrodes can be a single point structure or a multi-point structure (as shown in FIG. 1). The field enhancements greatly assist in creating localized voltage breakdown at the tip of the secondary electrode, initiating localized micro cracking, gas expansions, mobilization of pore water, heat, and carbon production in the formation near the borehole of high conductivity associated with channeling. The localized voltage breakdown extends toward the opposite electrode at a propagation rate of 0.5-10 m/hr. in one embodiment; at 1-5 m/hr. in a second embodiment; generally following the established electric field pattern of the electrodes.

The secondary electrodes can operate individually or in groups through cable connections inside the electrodes, and connected at the surface to switching power supplies. In one embodiment, the secondary electrodes are hydraulically actuated such that they are not protruding from the electrode surface into the formation unless called upon to do so to establish electrical contact with the formation. With the use of secondary electrodes, the initiation of a channel will occur at the depth of the extended electrodes, with other vertical channels being created in this manner for multiple channels. In one embodiment, the point electrode or secondary electrode employs a spring loaded pin to ensure a pressure contact against the borehole wall, for high voltage discharge into the formation with local electric field enhancement by the pin geometry and shape of the secondary electrode.

The depth of the active electrode may be variable in terms of frequency or wavelength. In one embodiment, the electromagnetic field patterns are created with the use of electrodes in the form of cables or pipes conducting high current are employed, as open-ended parallel wire transmission line having the highest electric field or maxima at the secondary (point) electrodes. The field pattern of a two electrode system is established by the potential difference between electrodes, spacing between electrodes, electrode length of each electrode, the dielectric properties of the formation, and frequency of the AC. Initiation of the electron avalanches in the formation occurs where the secondary point electrodes make physical contact with the formation. In one embodiment with the point electrodes being located in a metal casing, the electrodes cut or burn through the casing by high voltage discharge between the electrode point contact and casing wall, thus enabling contact of the point electrode to the formation. In one embodiment, the electrodes are designed to extend telescopically into the formation to effectively generate electron avalanches to initiate high voltage fracture conditions.

In one embodiment, the electromagnetic field pattern is created with the use of antenna structure, with a mosaic of antennas acting as electrodes. The antenna electrodes can be altered in time phasing of input current or voltage to change the energy distribution between boreholes, thereby achieve more uniform fracturing in the volume intended.

The secondary electrodes provide enhanced electric fields or high voltage gradients at specific points along the surface of the active electrode directed to the opposite electrode, generating radial electric fields. In one embodiment, the radial electric fields generated by the electrodes can be sufficiently enhanced to initiate an electron avalanche condition similar to a Townsend discharge with the injection of an easily ionizable gas (or "EIE"—easily ionizable element) through one or more ports provided in the electrode. Examples of easily ionizable gases include neon, argon, or a Penning mixture (99.5 percent neon and 0.5 percent argon). The gas injection can influence the characteristics of plasma discharge, as well as the current characteristics of the discharge (current intensity), increasing activity by lattice vibrations created by the electric field and temperature effects. The easily ionizable gas can be injected into the formation through separate ports, or through the point electrode ports. The intense fields originate at the electrode surface and terminate at the surface of the opposite electrode in the adjacent borehole. The electron avalanche created in the formation by the intense electric field at the surface of the positive polarity electrode creates a localized ionization effect in the rock, which propagates to the opposite electrode of negative polarity. It should be noted that similar conditions of voltage breakdown are occurring simultaneously at the opposite electrode of negative polarity with attendant propagation of ionization to the electrode of positive polarity.

In one embodiment, the electrode is a high voltage electrode packer (HVEP) system with at least a double packer, allowing extended penetration into the formation for improved fracture efficiency. The system comprises an upper packer and a lower packer and electrodes disposed between the upper and lower packer and defining a spark gap between the pair of electrodes. The high voltage electrodes in the double packer compartment are insulated from upper and lower metal structures outside the inflatable packers by the packer material itself, with the inflatable packers made from non-conductive material, e.g., fiberglass. The packers provide a sealed compartment for the high voltage electrodes, allowing a gas compartment to support lower breakdown voltages. In one embodiment, the HVEP system is provided with a plurality of injection ports, allowing the injection of gas mixtures (e.g., injected air gas into the formation) to measure permeability increase.

Figure 9:
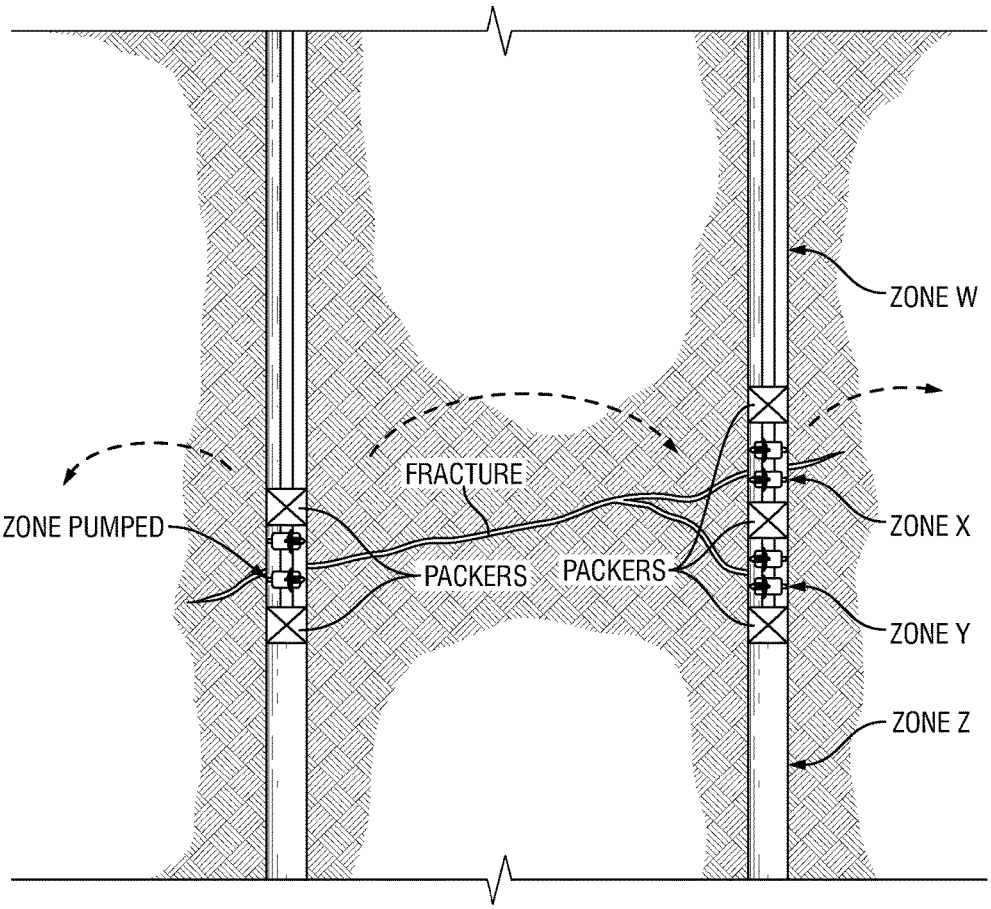
FIG. 9 illustrates an embodiment of a system employing a high voltage electrode packer (HEVP) system.

In one embodiment as shown in FIG. 9, a plurality of HVEP's are used with multiple electrodes for extended ground electrode effect. In yet another embodiment, a plurality of electrodes with single point structure are placed between special packers so as to widen the ground return aperture, or the size of effective ground created by the return electrode. With the plurality of electrodes, the grounding electrically dominates over other nearby potential grounding points at various distances from the return electrode borehole. The spreading of contact points ranges from ½ foot to 5-15 feet along the conductor in one embodiment, from 5 to 50 feet in a second embodiment. The positions of the electrodes can be either manually or automatically adjusted during the preconditioning phase. The re-position allows the focus of the electric field between the opposing electrodes (opposite voltage polarity) to be optimized for improving energy fracture efficiency.

In one embodiment, the enhanced electric field around each electrode initially results in dewatering of the material and micro cracking with physical spaces. This further enhances voltage gradient or electric fields around and adjacent to the electrode. The electric field enhancements ionize the material by high voltage breakdown mechanisms, whereby a wave of ionization begins propagation toward the opposite electrode. This enhanced electric field process of producing channels of high electrical conductivity between electrodes by ionization is similar to the stepping process of a lightning discharge, whereby a ionization leader is established that extends the ionization path from cloud to ground, cloud to cloud, or cloud to ionosphere. In the preconditioning step, physical and chemical changes in the rock material channel where ionization occurs may also increase the content of iron oxides, various ions, carbon, all of which enhance electrical conductivity.

The avalanche and resultant ionization directions of propagation will depend on the electrode design and relative locations of electrodes in the formation. In one embodiment, ionization of the formation dielectric creates a high value of electrical conductivity as that of carbon, e.g., a value of 10,000 S/m, allowing for multiple fracturing between electrodes by very high currents in ensuing applications of high voltage waveforms. Channels of intense currents, hundreds to thousands of amperes, develop shock waves in the dielectric material, leading to multiple fracturing with branching of fractures from the main current path directions.

The conductivity volume can be continuously monitored by electrode impedance measurements (e.g., Cole-Cole plots or Smith plots) to insure that the volume to be fractured has sufficiently low resistance or high conductivity in preparation for the application of very intense currents in the high-current fracturing step. The volumetric electrical resistance can be monitored by network analyzer measurements (e.g., Smith charts).

In one embodiment, the high conductivity channel effect gradually reduces the overall resistance between electrodes as measured at the surface by impedance measuring equipment. The ratios of final to initial channel conductivities may range from 10:1 to 50,000:1 in one embodiment, and from 100:1 to 1500:1 in a second embodiment.

In one embodiment of the pre-conditioning step, high voltage electricity, e.g., 1-200 kV is fed to the electrodes from a high voltage AC transformer at the surface. The electrodes can be steel tubing or pipes positioned within or outside a well casing. The electrodes establish controlled electric field patterns between each other to increase the probability of completing an electrical path between them. The resistance of the rock between the wells, e.g., may range from 100-10000 ohms. In one embodiment, the power supplied is at a frequency for which the electrical spacing between the electrodes is on the order of 1/10 wavelength or less in the body of the formation, ensuring an electric field that is between the pipe electrodes, e.g., as in a two wire transmission line.

In another embodiment, the electrode is in the order of a ¼ wavelength or multiples of a ¼ wavelength in length, such as to produce multiple voltage nodes or maxima along the electrode.

The high voltage energy of continuous waveform or of any arbitrary waveforms including pulsed waveforms can be produced by a generator which contains impedance and phase adjusting elements, and which supplies energy to the cables or pipes at the wellhead. As high voltage electricity is applied, the underground temperature in the area of the channel between the electrodes will exceed 300° F. in one embodiment, at least 500° F. in a second embodiment, and over 1000° F. in a third embodiment depending on electrode depth related to overburden pressure The high temperatures in one embodiment causes the connate water to expand resulting in fractures in the rock formation with low porosity/permeability, with pressure being released on the compressed rock by the opening of passages by fracturing.

The application of high voltage in the preconditioning step induces an electrical field between the opposite electrode contact points, and with continued application of high voltage electricity, a flow of current commences which creates a plasma arc at the contact in the formation for both electrodes, as the electricity tries to establish a better conducting path. Burning its way through the rock from either electrode, the highly conductive paths are created by these plasma arcs as they advance towards each other. The arcing continues until the two paths meet, leaving a highly conductive path between the electrodes. Additional conductive paths can be made by adjustment of electrode locations. Current flow through the rock is initially very low at the beginning of this process step, e.g., in the ampere range, and continuously increases as the highly conductive path is created. At a time when the highly conductive paths connect, the current flow increases rapidly approaching a "short circuit" condition wherein essentially from a few ohms to several thousand ohms of electrical impedance is encountered, indicating that pre-conditioning step to generate the highly conductive path is complete.

In one embodiment, the electrodes are disconnected from the high voltage transformer of the pre-conditioning step, and connected to an electrical system capable of generating a high current single waveform shaped of current of short time duration with specific rise and fall time and variable repetition rate. In one embodiment, the electrical system comprises a high voltage cascading capacitor bank that can discharge high voltage electrical energy in a very short period of time, e.g., with duration of the pulse of 1,000 ns to 1,000,000 ns in one embodiment; from 10,000 to 500,000 ns in a second embodiment. The capacitor bank can be rapidly charged and discharged to send a high energy electrical pulse through the electrodes, which is then applied to the highly conductive path through the rock formed in the first part of the process.

Electrical System:

In one embodiment, the electrical system is a surface system, comprising an impulse voltage generator, e.g., a Marx generator that can generate output from 100 kV to 2 megavolts of pulsed high voltage and output energy from 10-1000 kJ. An example of a Marx generator is disclosed in US Patent Publication No. 20110065161, incorporated herein by reference in its entirety. Pulsed high voltage generator is light weight and portable. Its modularity lends itself especially to field operations. A multi-stage Marx generator works by charging the capacitors through the charging resistors R'L with a rectified high voltage AC source in the form of a step-up transformer. The triggering of the first stage spark gap is initiated by a high voltage trigger electrode built into one of the spark gap spheres. The transient overvoltage and the UV radiation as a result of the first stage triggering causes the rest of the stages to trigger in rapid succession with very little time delay.

In one embodiment, the electrical system includes a high voltage DC power supply, which charges an energy storage component, such as a capacitor bank storing energy for delivery to the electrodes, e.g., between about 1-50 kJ (kilo joules) in one embodiment, between 50-100 kJ in a second embodiment, and between 100-500 kJ in a third embodiment. A high voltage switch is actuatable in order to discharge the capacitor bank and send energy to the electrodes. A secondary electrical system may be employed to provide pulsed power and actuated at a relatively higher frequency (e.g., in the kHz range) than the primary electrical system. The amount of stored energy released into the channels that has been preconditioned depends on the charging voltage, the capacitance, the series resistance of the impulse voltage generator, and the volume conductivity of the formation.

In one embodiment, the current waveform is of many shapes of intensity determined from surface impedance measurements made by a network analyzer, e.g., over a range of frequencies from 60 Hz to 10 MHz bandwidth, for a pulse waveform that delivers the most energy to the channel.

In one example of the energy delivery requirement of the impulse source, a 600 ampere peak current derived from a 600 kV impulse voltage source having a 1000 ohm source resistance is applied. After the AC preconditioning and for a final conductivity of the channel of 20 ohms over an electrode separation distance of two wire configurations of 112 feet, the peak power delivered to the channel is 7.2 megawatts. Assuming for example a conductive channel which is straight and perpendicular between opposite electrodes, a current impulse of 100 microseconds duration may deliver 720 Joules of energy or 21 Joules per meter channel length. With such localized power density, the channel explodes from plasma energy deposition with attendant rock disintegration and fracturing. In one embodiment with heavy carbon development in the channel, the effective electrical conductivity can be as high as 10,000 S/m, creating more intensive plasma conditions, rock fracture and disintegrations.

Applications:

The inventive method is suitable for different types of formations, e.g., tight gas, shale gas, tight oil, tight carbonate, diatomite, geothermal, coalbed methane, methane hydrate containing formations, mineral containing formations, metal containing formations, formations containing inorganic materials in general, bedrocks of very low permeability in the range of 0.01 microdarcy to 10 millidarcy, etc. In one embodiment, it is employed for rock with naturally occurring fractures containing free water or pore water, which may deter or create unintended electrical pathways between the contact electrodes and other electrical grounds. In one embodiment, the method is used for shale or natural gas shale formation, including tight rock formation with low permeability, e.g., Colorado oil shale as field tested by Melton and Cross, which has little or no measureable permeability.

In one embodiment, the method is used for formations rich in oil shale, e.g., more than 35 gallons of oil per ton of rock (GPT), having a high kerogen content compared to a lean shale formation averaging 10 GPT. With high GPT shale rock formations, more carbon can be created for the conductive path.

In one embodiment with intrinsically high carbon formations, the preconditioning AC power could be increased with less impulse power needed. In embodiments with zero or low carbon content formations, the impulse waveform would be the energy driver to achieve fracture through plasma induced rock disintegration. The volume of the formation to be fractured by high voltage, high current waveforms) can be defined by the location of electrode boreholes and their ability to produce highly focused concentrations of electric field energy.

In the electrical fracture method for subsurface rock formations, it is theorized here that pore volumes of adequate size containing connate water can provide highly conductive electrical plasma conditions similar to the burning water phenomena except at subcritical and supercritical temperatures and pressures. By control of both temperature and pressure, the connate water in pore volumes can be quickly heated with electromagnetic energy to temperatures into the supercritical fluid range (starting at ~374 C and 100 bar or 100 kPa), whereby the hydrogen bonds of the water are destroyed, resulting in hydrogen and hydroxide ions and gases. Under which conditions, shock waves are created from supercritical water plasma.

In one embodiment, the method is used for rock fracture in geothermal reservoirs under near supercritical fluid conditions (the supercritical fluid point for water is 3225.9 psi or 222.42 bar and 374.4° C.), practically optimizing the water electrical properties. The waters at this depth have the chemical properties of near supercritical fluids which involve hydronium ions, hydroxide ions and free electrons. Application of impulsive electromagnetic energy by electrodes would create plasma shock waves from the very high current densities that can be induced in these waters. Such shock waves would create fracture.

An example of such geothermal formation include the geothermal fields of Iceland with reservoir pressures in excess of 200 bar and temperatures in excess of 300° C. at depths >2000 meters. Water at such depths and corresponding high temperature is considered a supercritical fluid because of the very weak hydrogen bonding at 22 MPa and 374° C. Supercritical fluids are rich in ions (hydronium and hydroxide ions), are therefore high in electrical conductivity. The supercritical conditions and properties allow plasma shock waves in water to be quickly developed with high energy electrical pulses, resulting in rock disintegration and fracture. The explosive forces of sudden plasma creation in geothermal formations using electromagnetic methods allows energy efficient fracturing with down hole electrode installations for implementing controlled and directed fracturing.

It has been demonstrated that ion product of water rises to $10^{-11}$ in sub-critical condition, while it is $10^{-14}$ in atmospheric condition. Thus, the method is also suitable for formation with water under subcritical conditions (also high in ion content) to cause rock disintegration and fracture, with the formation of active species (e.g., H, OH, ions, free electrons) which are unstable molecules with high ionic reactivity.

In one embodiment, the method is used for hydrocarbon recovery in new reservoirs to generate fractures for subsequent recovery of hydrocarbons. It can also be used in mature fields to help improve recovery, e.g., creating pathways for subsequent waterflooding, steamflooding, or fireflooding. Produced hydrocarbons can be natural gas, oil, condensate, or combinations thereof. Mature fields are broadly defined as hydrocarbon fields where production has already peaked and is currently declining.

In another embodiment, the method is used for geothermal applications, generating fractures/pathways in the hot rocks, followed by the injection/pumping of water (or brine) into the formation for circulation through the fractures, and subsequent recovery of steam/hot water from the geothermal hot formation.

In yet another embodiment, the method is used in mining applications. In some embodiments, the method is used in instances of coal mining where the coal lacks permeability. In highly impermeable coal formations, the method is employed to generate "controlled" fractures through the strata in which the boreholes with electrodes are situated to generate new coal seams.

In one embodiment, the method is applicable for solution mining applications. Many minerals are particularly suitable for recovery by thermal solutions flowing through rock fractures. For example, host rocks for some minerals such as sulfide ore deposits have very low permeability. Major fractures with high flow channels may short circuit the solution. The method facilitates many "controlled" fractures in terms of pattern, size, and length in the appropriate strata, to channel the flow of thermal solutions to maximize mineral recovery.

In one embodiment for the extraction of metals such as copper, it is believed that in the method with the high voltage pre-conditioning and pulsing to create the conductive channel(s) and fractures within and about the channel(s), the metals to be extracted react with minerals in the formation to generate chemical complexes which facilitate the mining process.

In some embodiments of mining applications, e.g., metals including precious metals, minerals, inorganic materials, etc., the method can be employed to change the characteristics of the materials to be extracted from the formation, for the generation of materials of economic values. In other mining applications, the method is a "pre-treating" step, employed to fracture and weaken the strength of rocks with boreholes of shallow depth, optionally followed by dousing of the formation and the fractures with solutions to further weaken the formation, after which mining can be initiated or continued. When hard rock surface is reached, the method can be used again to weaken or "pre-treat" the rock, followed by mining, followed by the "pre-treatment" if more hard rock is encountered, so on and so forth.

The method is applicable for environmental remediation. For example, the recovery of certain light non-aqueous phase liquid (LNAPL) materials such as benzene, toluene, xylene, etc. can be challenging in complex fracture bedrock sites, e.g., granite, due to the very low permeability and pore volumes. LNAPL migration and distribution in bedrock is primarily governed by fracture properties, such as orientation, aperture and interconnectivity, with matrix porosity and hydrogeology also playing important roles. Vertical or high angle fractures typically serve as the primary conduits for flow through the unsaturated zone to the water table. When vertical fractures intersect horizontal fractures, LNAPL will spread laterally. If LNAPL thicknesses and vertical fracture apertures are great enough, then LNAPL can migrate below the water table. Significant changes in groundwater elevations, due to pumping, seasonal, or tidal influences, can also result in entrapment of LNAPL below the water table. In one embodiment, the method is used to create fractures to channel the flow of LNAPL into "controlled" pathways or openings in the rock. In yet another embodiment, the method is used to create fractures to generate permeable pathways to allow special chemicals to migrate into source region containing undesirable materials, whether in liquid or solid form, for desorption of the materials from the bed rock interfaces.

Down-Hole Diagnostic:

Examination of the downhole fractures in one embodiment can be made with a borehole radar as disclosed in USGS Fact Sheet 054-00 with a publication date of May 2000, publication titled "Fracture Characterization Using Borehole Radar" as published in Water, Air, and Soil Pollution: Focus (2006) 6: 17-34; a system and method as disclosed in US Patent Publication No. 20140032116A1 ("Multicomponent borehole radar systems and methods"), or a short-range borehole radar as disclosed in PCT Patent Publication No. WO 2013149308 A1, which references are incorporated herein by reference.

In one embodiment, the borehole-radar reflection method provides information on the location, orientation, and lateral extent of fracture zones that intersect the borehole, and can identify fractures in the rock surrounding the borehole that are not penetrated by drilling. The cross-hole radar logging provides cross-sectional maps of the electromagnetic properties of bedrock between boreholes, which can be used to identify fracture zones (as shown in FIG. 9) and lithologic changes. The borehole-radar logs can be integrated with results of surface-geophysical surveys and other borehole-geophysical logs, such as acoustic or optical televiewer and flowmeter, to distinguish transmissive fractures from lithologic variations or closed fractures. In one embodiment, the borehole radar is used to gather information related to any of distribution, size of fracture and propagation velocity about the multiple fractures generated in the formation.

In the borehole-radar reflection method, one or more sets of transmit and receive antennas are lowered down an open or cased borehole and each of two sets may be positioned above and below the electrode. A radar pulse is transmitted into the bedrock surrounding the borehole. The transmitted pulse moves away from the borehole until it encounters material with different electromagnetic properties, e.g., a fracture zone, change in rock type, or a void. A radar reflection profile along the borehole can be created by taking a radar scan at each position as the antennas are moved up or down the borehole. Radar reflection logging can be conducted with omni-directional or directional receiving antennas.

EXAMPLE

The example is given to illustrate the invention. However, the invention is not limited to the specific conditions or details described in the example.

In the pilot test, a two parallel horizontal borehole system giving a distribution of the electric fields as in a two-wire transmission line system was employed in an oil shale formation. The system employed high voltage AC and impulse energy for rock fracture. The wire or conductor (could be flexible or rigid) transferred the high voltage currents in borehole to the required depth, with electrical contact at the distal end of the downhole assembly, and with dielectric sleeve on the conductor over its entire length except at the contact point to isolate voltages from the non-contact portions of the conductor.

Figure 7:
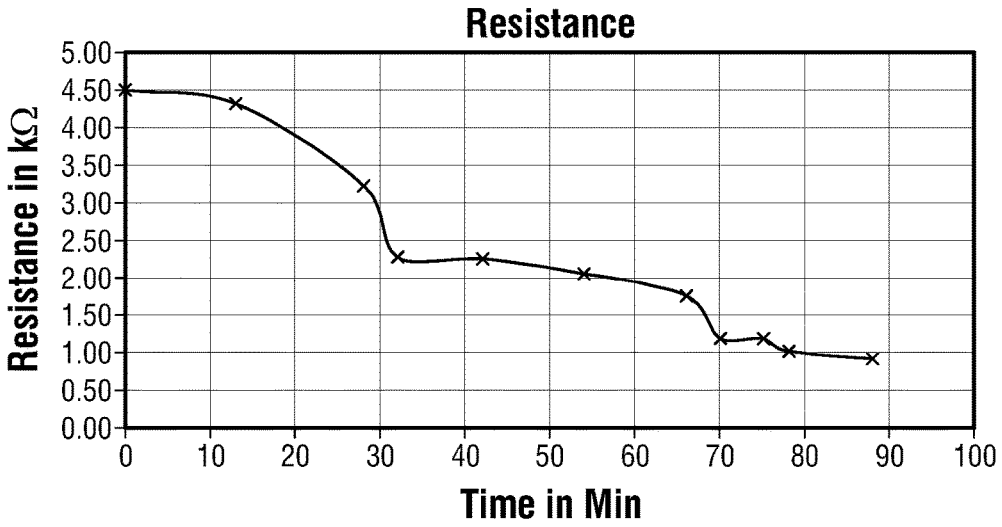
FIG. 7 is a graph showing the change in initial resistance or resistivity as a function of time for the pilot test.
Figure 8:
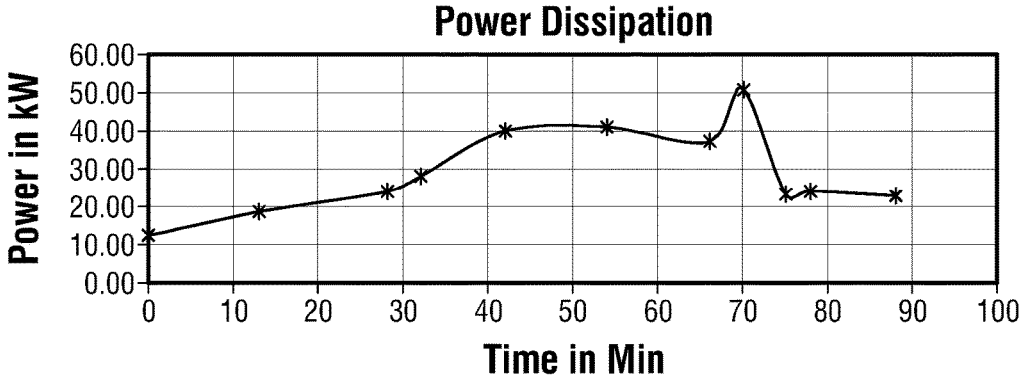
FIG. 8 is a graph showing the power dissipation as a function of time for the pilot test.

Immediately following AC pre-conditioning, a maximum of 40 kilojoules of electrical energy was delivered every minute at peak voltages of 800,000 volts to the formation. Measureable fracture pathways were created up to electrode spacings of over 150 feet. Significant permeability enhancement was measured after several hours of energy application by the combination of AC preconditioning and high voltage impulse cycling. As the high voltage discharge burned through the formation between the point electrodes, the initial resistance decreased with time from 4.5 kΩ to values less than 1 kΩ as illustrated in FIG. 7. The power dissipation is as illustrated in FIG. 8.

Reference will be made to the Figures, showing various embodiments of the invention.

FIG. 1 illustrates a system in which secondary (point) electrodes are employed to generate high electric field intensities to initiate electron avalanching and voltage breakdown at selected points along the electrode. Positioned in a formation and extending through the overburden are a plurality of electrode structures, spaced apart therein which as is show here by way of example, as a two wire transmission line configuration. The high voltage (HV) hollow or solid pipe or cable (76) is located inside a metal casing (78) and insulated from it by insulators (80, 82). The distal end of the cable is electrically connected to a hollow metal pipe or active electrode having multiple point electrodes (70) on its surface. The proximal end of the HV cable end is connected to the HV generator (92), which is a step-up high voltage transformer with oil or SF6 as insulating medium. The output is regulated on the primary side of the transformer with variable transformer or phase controlled SCR (silicon control rectifiers). The point electrodes greatly amplify the radial electric field intensity at specific points along the active electrode. These point electrodes initiate an electron avalanche condition in the adjacent formation with resulting ionization and voltage breakdown that propagates along high concentration lines of flux of electric field intensity between boreholes.

The metal casings (78) are spaced apart by a distance in the formation, determined by the characteristics of the rock related to the dielectric and physical properties and the frequency to be used for preconditioning. In one embodiment, low frequencies are employed, e.g., 50 Hz-50 kHz, for preconditioning by a generator operating as a high voltage continuous wave source of energy. For example, if 60 Hz is to be used, spacing on the order of 125 to 200 feet is desirable. Other spacing's may be used depending on drilling expense as well as other factors. In one embodiment to reduce undesirable radiation of electromagnetic energy in the formation, the active electrode spacing is less than ⅛ wavelength in the formation, such that the active electrodes may be energized in phase opposition to produce captive electric fields between the casings (78).

The portion of the HV cable or pipe inside the casing (78) and insulated from it creates shielding and grounding for the high voltage. A metallic screen (94) may be used positioned on the ground intermediate to the casings (78) and a ground connection from the generator for system grounding purposes. At high frequencies such as 1 MHz, it may also help to reduce any stray radiation from casings (78).

In one embodiment, the generator (impulse current generator) is a Marx generator, with output from hundreds of kilovolts to megavolts of pulsed high voltage into a low resistance load (after preconditioning) based on the principle of parallel charging of capacitor banks and then series discharging through triggered spark gaps. The preconditioned volume of conductive material allows high currents to be efficiently transmitted from electrode to electrode for the creation of intense shock waves that result in rock disintegration of minerals, pyrolysis of organic materials, and physical expansion of the formation resulting in multiple fracturing.

Figure 2:
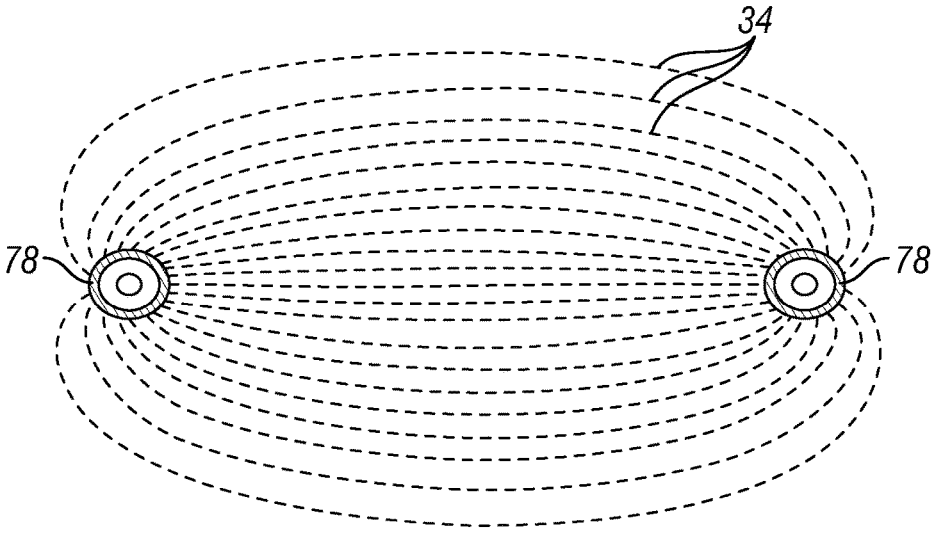
FIG. 2 illustrates the electric field concentrate along the channel between the two electrodes.

FIG. 2 illustrates the electric field concentrate along the channel between the two electrodes. As shown, the electric field of the active electrode concentrates immediately adjacent the active electrodes (70) and is reduced by distance away from the casings (78). The maximum concentrations will exist at the tip of the point electrodes on active electrodes (70) and indicated by the high density of electric field flux lines between casings. The wave fronts of ionization will tend to follow within this high density of flux line region (34). Low ionizable gas injections from ports at or near the point electrodes will assist in creating ionization pathways between the electrodes.

By supplying sufficient electric energy to create the ionization pathways between casings (78), formation physical changes (e.g., micro fracturing and localized rock disintegration) and high formation electrical conductivity develops in the regions of the propagating electrical discharge or ionization between casings (78). Low transmission line impedance will be measureable at the input to the cable or pipe where the generator connection is made corresponding to the increasing conductivity. The regions of high formation electrical conductivities are variable based on the locations of the point electrodes (70) along the active electrodes surfaces.

Figure 3:
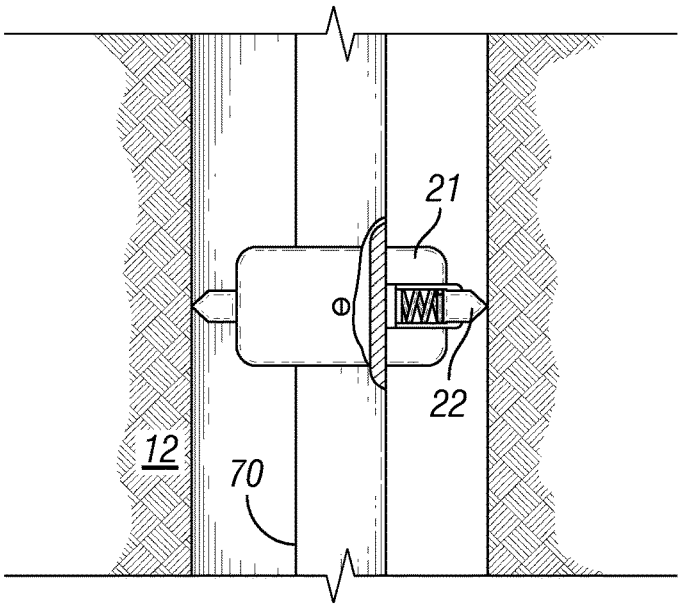
FIG. 3 illustrates an embodiment of an electrode enhanced with secondary electrode in the form of a metal point.

FIG. 3 illustrates an embodiment of an electrode enhanced with secondary electrode in the form of a metal point with spring loaded pins. The active electrode (70) is shown in a position in borehole (12). A spring loaded pin (21) insures a pressure contact against the opposite side of the borehole wall with pin (22), sufficient for high voltage electrical discharge into the formation from local electric field enhancement by the pin geometry.

Figure 4:
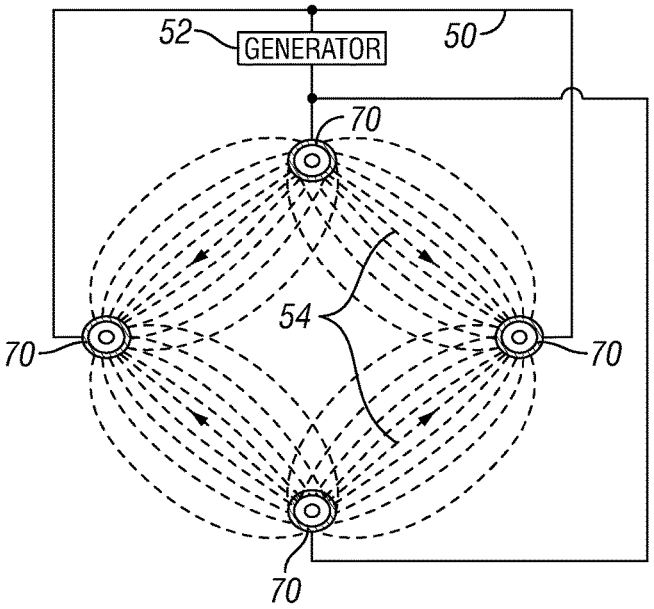
FIG. 4 illustrates an embodiment of a four-electrode structure.

Referring to FIG. 4, there is shown a section of a four-electrode structure to expand on a two-hole fracture layout of FIG. 1, wherein the electrodes can be generally of the same type. In one embodiment, the electrodes are positioned on the corners of a square and energy is delivered as indicated diagrammatically by wires (50) out of phase from a HV generator (52). The generator includes impedance matching and phase matching structures to opposite corners of the square or four spot pattern of electrodes, so that adjacent electrodes along each side of the square are fed out of phase with energy and produce electric fields at a given distance with arrows (54) as shown. Such a pattern is made more uniform over the field pattern shown in FIG. 2, allowing for a greater volume of preconditioning with a more uniform increase in electrical conductivity. In one embodiment with secondary (point) electrodes, the secondary electrodes can greatly enhanced electric field intensities at the electrode surface at the points where they make contact with the formation.

It should be noted that different electrode patterns can be employed other than the two- and four-electrode structures as shown. A plurality of the same or different patterns can be employed. Some or all of the electrodes can be further enhanced with the secondary (point) electrodes along the length of the active electrode surfaces. The secondary electrodes can be spaced at equal or variable distance along the electrode lengths, and distance between each pair of electrodes can be the same or different, depending on the desired fracture patterns for the formation.

Figure 5:
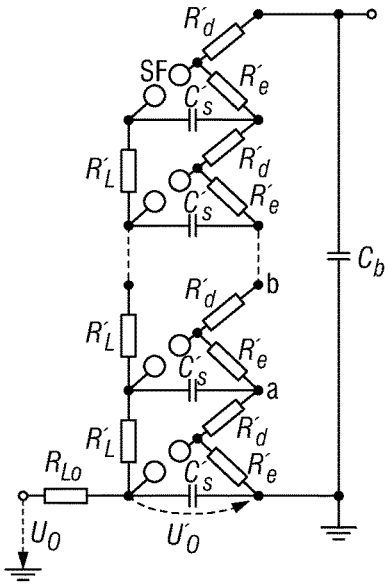
FIG. 5 is a circuit diagram illustrating an embodiment of a multi-stage impulse voltage generator.

FIG. 5 is a circuit diagram illustrating an embodiment of a multi-stage impulse voltage generator. Depending on the number of stages, the generator can deliver 100-2000 kV peak pulsed output voltage of a double exponential waveforms with varying rise and fall times, with total stored energy ranging from 10-1000 kJ. In one embodiment, each stage consists of a 100 kV, 1 μF capacity C's, a spark gap switch in high pressure $SF_6$ gas, charging resistor R'L, series resistor R'd and parallel resistor R'e. By varying the resistance and the load capacitance, the output waveforms can be changed with the output voltage being a function of the charging voltage.

Figure 6:
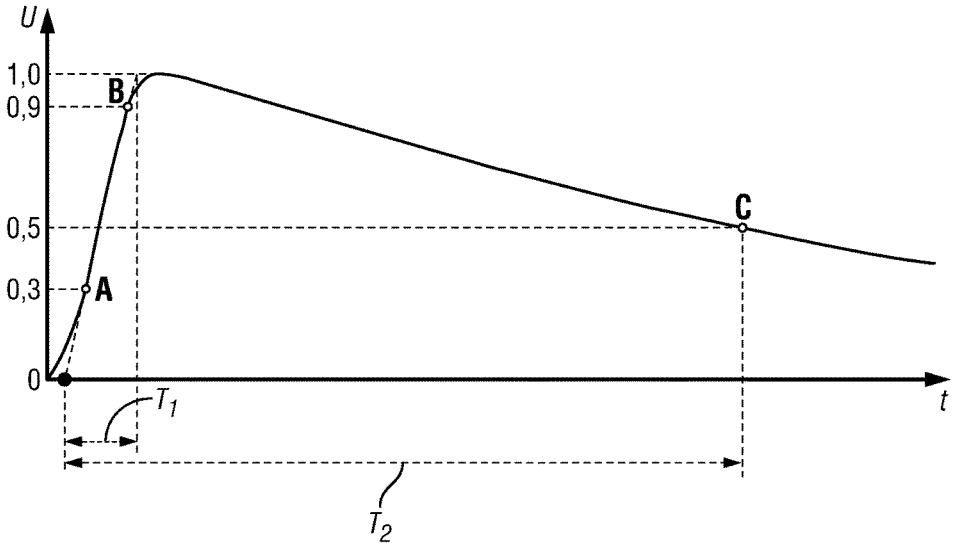
FIG. 6 is graph illustrating a standard full lightning impulse voltage.

FIG. 6 is a graph showing a standard lightning impulse voltage waveform for one embodiment, in which the voltage rises to its peak value u in a minimum amount of time, e.g., a rise (front) time of 1.2 μs, and falls appreciably slower to a half-value (tail) of 50 μs, and ultimately back to 0, for a 1.2/50 impulse voltage.

The claimed subject matter is not to be limited in scope by the specific embodiments described herein. Indeed, various modifications of one or more embodiments disclosed herein in addition to those described herein will become apparent to those skilled in the art from the foregoing descriptions. Such modifications are intended to fall within the scope of the appended claims.

As used in this specification and the following claims, the terms "comprise" (as well as forms, derivatives, or variations thereof, such as "comprising" and "comprises") and "include" (as well as forms, derivatives, or variations thereof, such as "including" and "includes") are inclusive (i.e., open-ended) and do not exclude additional elements or steps. Accordingly, these terms are intended to not only cover the recited element(s) or step(s), but may also include other elements or steps not expressly recited. Furthermore, as used herein, the use of the terms "a" or "an" when used in conjunction with an element may mean "one," but it is also consistent with the meaning of "one or more," "at least one," and "one or more than one." Therefore, an element preceded by "a" or "an" does not, without more constraints, preclude the existence of additional identical elements.

The use of the term "about" applies to all numeric values, whether or not explicitly indicated. This term generally refers to a range of numbers that one of ordinary skill in the art would consider as a reasonable amount of deviation to the recited numeric values (i.e., having the equivalent function or result). For example, this term can be construed as including a deviation of ±10 percent of the given numeric value provided such a deviation does not alter the end function or result of the value. Therefore, a value of about 1% can be construed to be a range from 0.9% to 1.1%.

For the avoidance of doubt, the present application includes the subject-matter defined in the following numbered paragraphs:

The invention claimed is:

1. A system for generating fractures in geologic formation, the system comprising:

a plurality of electrodes placed in a formation in a plurality of boreholes, wherein for the plurality of electrodes define a fracture pattern for the geologic formation;

a preconditioning generator for delivering energy comprising AC power to the electrodes to generate at least one conductive channel between a pair of the electrodes with the conductivity in the channel having a ratio of final to initial channel conductivity of 10:1 to 50,000:1, the energy applied to the electrodes to generate the conductive channel is selected from electromagnetic conduction, radiant energy and combinations thereof;

an impulse generator for generating electrical impulses with a voltage output ranging from 100-2000 kV, with the pulses having a rise time ranging from 0.05-500 microseconds and a half-value time of 50-5000 microseconds;

wherein the application of the electrical pulses generate multiple fractures surrounding and within the conductive channel by disintegration of minerals and inorganic materials and pyrolysis of organic materials in the formation.

2. The system of claim 1, wherein the preconditioning generator comprises electrical equipment to supply voltages and currents at a pre-select frequency for the fracture pattern.

3. The system of claim 1, wherein the energy applied to the electrodes is varied by time phasing of input current or voltage to change energy distribution between the electrodes in the boreholes and thereby controlling fracturing in the formation.

4. The method of claim 1, wherein the sufficient amount of energy ranges from 1 kV to 2 MV at a frequency range of 0 to 100 MHz for any of continuous waveforms and pulsed waveforms.

5. The system of claim 1, wherein the electrodes are positioned within the boreholes for forming electrode configurations selected from two-wire transmission line, four-wire transmission line, cage-like-transmission line structure, antennas, and combinations thereof.

6. The system of claim 1, wherein each electrode is electrically connected to a cable or a cylinder located within a borehole.

7. The system of claim 1, wherein each electrode of the plurality of electrodes is contained within a borehole wall and at least one electrode of the plurality of electrodes is in contact with the borehole wall through a spring loaded pin.

8. The system of claim 1, wherein each electrode of the plurality of electrodes is contained within a borehole wall and at least one electrode of the plurality of electrodes extends into the formation through the borehole wall by telescopic means.

9. The system of claim 1, further comprising an impedance spectroscopy for measuring a resultant change in resistivity of volume of the formation to be fractured between a pair of boreholes.

10. The system of claim 1, further comprising a network analyzer for measuring dielectric constant changes over a frequency range from 60 Hz to 10 MHz.

11. The system of claim 1, wherein the impulse generator includes generating a voltage waveform to provide shock waves generating the multiple fractures between the electrodes.

12. The system of claim 11, wherein the voltage waveform has a frequency spectrum coinciding with a Cole-Cole plots for complex dielectric constant and Smith Chart plots for complex impedance.

13. The system of claim 11, wherein the voltage waveform has a frequency spectrum coinciding with a frequency range of lowest formation resistivity and maximum shock wave effect.

14. The system of claim 11, wherein the impulse generator is characterized by having a voltage and a current with a plurality of shapes varying according to any of pulse, damped sine wave, and exponential decay.

15. The system of claim 1, wherein at least one of the electrodes further comprises a plurality of secondary electrodes.

16. The system of claim 1, wherein at least two electrodes are employed in each borehole.

17. The system of claim 1, further comprising a borehole radar to gather any of distribution, size of fracture and propagation velocity about the multiple fractures generated in the formation among sets of boreholes.

18. The system of claim 1, further comprising a plurality of double packers, with each double packer comprising an upper packer and a lower packer, having at least one electrode disposed between the upper and lower packer defining a compartment for containing the at least one electrode.

19. The system of claim 18, wherein the packers are inflatable packers.

20. The system of claim 19, wherein the inflatable packers are made from non-conductive materials.

21. The system of claim 1, wherein a single generator is both the preconditioning generator and the impulse generator.

* * * * *